US010975514B2

(12) United States Patent
Behr et al.

(10) Patent No.: US 10,975,514 B2
(45) Date of Patent: Apr. 13, 2021

(54) WASHING MACHINE AND METHOD FOR DISPLAYING A DETERGENT FILL LEVEL

(71) Applicant: Miele & Cie. KG, Gütersloh (DE)

(72) Inventors: Markus Behr, Bielefeld (DE); Viktor Wiens, Bielefeld (DE); Jan Niclas Laumann, Harsewinkel (DE)

(73) Assignee: Miele & Cie. KG, Gütersloh (DE)

( * ) Notice: Subject to any disclaimer, the term of this patent is extended or adjusted under 35 U.S.C. 154(b) by 0 days.

(21) Appl. No.: 16/753,356

(22) PCT Filed: Oct. 1, 2018

(86) PCT No.: PCT/EP2018/076663

§ 371 (c)(1),
(2) Date: Apr. 3, 2020

(87) PCT Pub. No.: WO2019/072614

PCT Pub. Date: Apr. 18, 2019

(65) Prior Publication Data

US 2020/0332455 A1 Oct. 22, 2020

(30) Foreign Application Priority Data

Oct. 10, 2017 (DE) ..... 10 2017 123 519.1

(51) Int. Cl.

| | |
|---|---|
| ***D06F 39/02*** | (2006.01) |
| ***D06F 34/32*** | (2020.01) |
| ***G08B 5/36*** | (2006.01) |
| *D06F 105/58* | (2020.01) |
| *B65D 25/54* | (2006.01) |

(52) U.S. Cl.
CPC ..... *D06F 39/022* (2013.01); *D06F 34/32* (2020.02); *G08B 5/36* (2013.01); *B65D 25/54* (2013.01); *D06F 2105/58* (2020.02)

(58) Field of Classification Search
CPC ..... A47L 15/44; G08B 5/36
See application file for complete search history.

(56) References Cited

U.S. PATENT DOCUMENTS

| | | | | |
|---|---|---|---|---|
| 5,873,268 | A | 2/1999 | Spriggs et al. | |
| 2004/0188467 | A1* | 9/2004 | Miefalk | G01F 13/005 222/156 |

(Continued)

FOREIGN PATENT DOCUMENTS

| | | | |
|---|---|---|---|
| DE | 102005049078 | A1 | 4/2007 |
| DE | 102009028066 | A1 | 2/2011 |
| DE | 102015112719 | A1 | 2/2017 |

(Continued)

OTHER PUBLICATIONS

European Patent Office, Rijswijk, Netherlands, International Search Report of International Application No. PCT/EP2018/076663, dated Dec. 14, 2018, 3 pages.

*Primary Examiner* — Hongmin Fan
(74) *Attorney, Agent, or Firm* — Dickinson Wright PLLC

(57) ABSTRACT

A washing machine (100) has a slide-in compartment (102) for the insertion of at least one detergent container (104, 106), which is translucent at least in sections, at least one light source arranged in the slide-in compartment (102) for illuminating the detergent container (104, 106), and a control device configured to control the light source according to a fill level of the detergent container (104, 106).

11 Claims, 3 Drawing Sheets

(56) References Cited

U.S. PATENT DOCUMENTS

| | | | | |
|---|---|---|---|---|
| 2007/0195537 | A1* | 8/2007 | Mayer | G02B 6/0068<br>362/362 |
| 2014/0236328 | A1* | 8/2014 | Kamon | D06F 33/00<br>700/90 |

FOREIGN PATENT DOCUMENTS

| | | | |
|---|---|---|---|
| EP | 2 000 577 | A1 | 12/2008 |
| GB | 2128640 | A | 5/1984 |
| WO | 2011012468 | A2 | 2/2011 |
| WO | 2013045299 | A1 | 4/2013 |

* cited by examiner

WASHING MACHINE AND METHOD FOR DISPLAYING A DETERGENT FILL LEVEL

TECHNICAL FIELD

The invention relates to a washing machine and to a method for displaying a fill level of a detergent container in a washing machine.

BACKGROUND

The empty state of a detergent container in a washing machine may be displayed, for example, in text form on a display of the washing machine. Approaches are also known in which the empty state may be displayed by means of light-emitting diodes.

SUMMARY

Against this background, the present invention has for its object to create an improved washing machine and an improved method for displaying a fill level of a detergent container in a washing machine.

According to the invention, this object is achieved by a washing machine and a method having the features of the independent claims. Advantageous refinements and developments of the invention result from the subsequent dependent claims.

The invention offers the advantage that, by illuminating an at least partially-transparent or translucent detergent container, an empty state of the detergent container may be displayed. The detergent container acts as a light guide in this case. This means that the empty state may be displayed directly on the detergent container. This has the advantage that the user of the washing machine may immediately see which of the detergent containers is empty, for example when several detergent containers are used at the same time. The empty state display by illuminating the detergent container can, for example, be implemented in addition to the empty state display in text form on a display of the washing machine. A particularly advantageous effect may be achieved, for example, if the detergent container is made to blink by rhythmic illumination when the empty state is detected.

A washing machine is presented that comprises a slide-in compartment for inserting at least one detergent container which is at least partially transparent; at least one light source arranged in the slide-in compartment for illuminating the detergent container; and a control device configured to control the light source as a function of a fill level of the detergent container.

The term "washing machine" as used in the present disclosure designates a water-conveying household appliance. In particular, the washing machine may be a laundry handling device, also in the form of a washer dryer. Alternatively, however, a washing machine may also be a dishwasher.

The term "slide-in compartment" as used in the present disclosure designates a compartment that, for example, may be accessible from a front of the washing machine. The slide-in compartment may be arranged above or below a washing drum of the washing machine. To guide the detergent container when it is pushed into the slide-in compartment, the slide-in compartment may have, for example, a corresponding guide rail. For example, the slide-in compartment may be configured to hold two detergent containers.

The detergent containers may be inserted one next to the other into the slide-in compartment, which is also known as a TwinDos system.

The term "detergent container" as used in the present disclosure designates an exchangeable cartridge for storing a fabric treatment agent or another cleaning or care agent, for example also for cleaning the washing machine. The detergent container can, for example, be cylindrical or cuboid. Depending on the embodiment, the detergent container may be inserted in the longitudinal direction horizontally, vertically or obliquely into the slide-in compartment. The detergent container may be made in sections or entirely from a transparent or translucent material, in particular a corresponding plastic.

For example, it is particularly advantageous if a front face of the detergent container, which faces the appliance front of the washing machine when the detergent container is pushed in, and a rear side of the detergent container opposite the front face are made of the translucent material. As such, for example, the front face may be backlit by illuminating the back side.

The detergent container may be inserted, for example, into the slide-in compartment in such a way that at least a portion of the front face is visible from the outside when the detergent container is inserted.

A light source may be, for example, a light bulb or a light-emitting diode or an arrangement of a plurality of light bulbs or light-emitting diodes. The light source may be aligned with the inserted detergent container so that the same may be illuminated in a targeted manner. For this purpose, the light source may be arranged on a wall section of the slide-in compartment, for example on a rear wall or side wall, or a floor or a ceiling of the slide-in compartment.

A control device may be understood to be an electrical device that processes sensor signals and outputs control and/or data signals as a function thereof. The control device may have an interface that may be configured with hardware and/or software. In the case of a hardware design, the interfaces may be part of a so-called ASIC system, for example, which contains a wide variety of functions of the control device. However, it is also possible that the interfaces are separate, integrated circuits or at least partially consist of discrete components. In the case of a software design, the interfaces may be software modules that are present, for example, on a microcontroller in addition to other software modules.

According to one embodiment, the light source may be arranged on a rear wall of the slide-in compartment. Additionally or alternatively, the light source may have at least one light-emitting diode. A rear wall of the slide-in compartment may be, for example, a wall section of the slide-in compartment which is opposite an opening of the slide-in compartment. The rear wall may lie opposite the detergent container when it is pushed into the slide-in compartment, for example in such a way that the light source is at a maximum distance of 3 cm from the detergent container. This embodiment enables effective backlighting of the detergent container with high light intensity.

According to a further embodiment, the control device may be configured to switch on the light source when the fill level reaches a lower threshold value, the lower threshold value representing an empty detergent container. This means that the empty state of the detergent container may be displayed directly on the detergent container.

The control device may be configured to switch the light source on and off alternately when the fill level reaches the lower threshold value. This may make the detergent compartment blink. The signal effect of the empty state display may be increased in this way.

Furthermore, the control device may be configured to switch off the light source when the fill level reaches an upper threshold value, the upper threshold value representing a full detergent container. As a result, an empty and/or full detergent container may be displayed simply by switching the light source on and/or off.

In addition, the control device may be configured to control the light source depending on the presence of the detergent container in the slide-in compartment. For example, the control device may be configured to illuminate the slide-in compartment by means of the light source in the absence of a detergent container, in order to make it easier for the user to insert the detergent container. This increases the ease of use of the washing machine.

According to a further embodiment, the washing machine may have a housing flap for closing the slide-in compartment. The control device may be configured to control the light source depending on a position of the housing flap. A housing flap may be, for example, a pivotable or removable cover element for covering the opening of the slide-in compartment. This embodiment may ensure, for example, that the detergent container is only illuminated when the slide-in compartment is open.

The light source may advantageously be designed to emit light in a variable color spectrum. The control device may be configured to vary the color spectrum depending on the fill level. As a result, the detergent compartment may be lit in different colors, producing a strong effect.

The washing machine may comprise the detergent container, which is inserted into the slide-in compartment.

The approach presented here also creates a method for displaying a fill level of a detergent container in a washing machine according to any one of the above embodiments, the method comprising at least the following step:

outputting a control signal for controlling the light source using a measured value representing a measured fill level of the detergent container.

This method enables an empty state display with a strong effect locally on the detergent compartment.

This method may be implemented, for example, in software or hardware or in a mixed form of software and hardware, for example in a control device.

An exemplary embodiment of the invention is shown purely schematically in the drawings and is described in more detail below. The drawings are provided herewith for purely illustrative purposes and are not intended to limit the scope of the present invention.

DETAILED DESCRIPTION OF THE DRAWINGS

Figure 1:
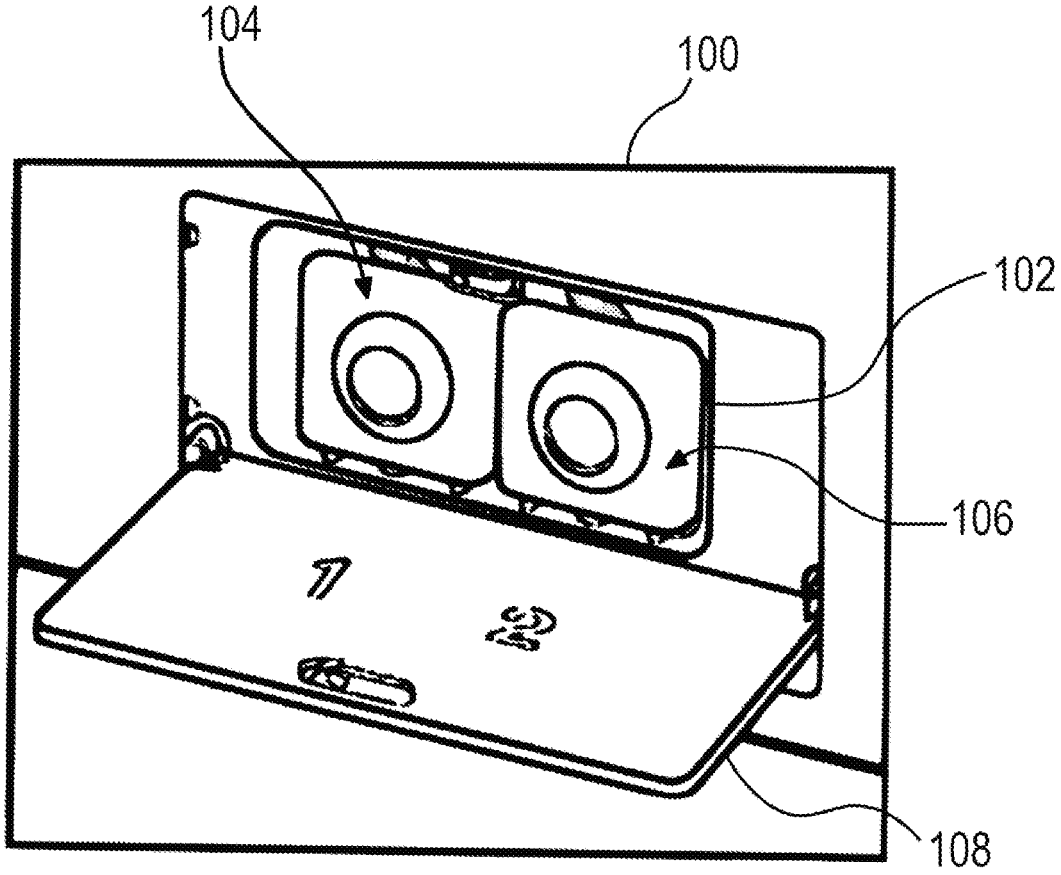
FIG. 1 shows a schematic illustration of a section of a washing machine according to an exemplary embodiment.

FIG. 1 shows a schematic illustration of a section of a washing machine 100 according to an exemplary embodiment. As an example, the section shows a slide-in compartment 102 arranged below a washing drum of the washing machine 100 for the insertion of a first detergent container 104 and a second detergent container 106. The slide-in compartment 102 is accessible from an appliance front of the washing machine 100. The two detergent containers 104, 106 are each shown in a fully inserted state in which each front face of the detergent containers 104, 106 facing the housing front is visible. The detergent containers 104, 106 are, for example, cuboidal and may be inserted into the slide-in compartment 102 in the longitudinal direction.

In order to locally indicate to a user of the washing machine 100 that the detergent containers 104, 106 are empty, the washing machine 100 is configured, for example, to backlight the given detergent container inside the slide-in compartment 102 in such a way that the front side of the given detergent container lights up clearly visible from the outside. For this purpose, the detergent containers 104, 106 are completely or partially translucent, depending on the exemplary embodiment, for example because a transparent or translucent plastic is used as the container material.

According to this exemplary embodiment, the slide-in compartment 102 may be closed with a pivotable housing flap 108. According to one exemplary embodiment, the washing machine 100 is configured to illuminate the detergent containers 104, 106 depending on a position of the housing flap 108. For example, these are only illuminated when the housing flap 108 releases the slide-in compartment 102, as shown in FIG. 1.

Figure 2:
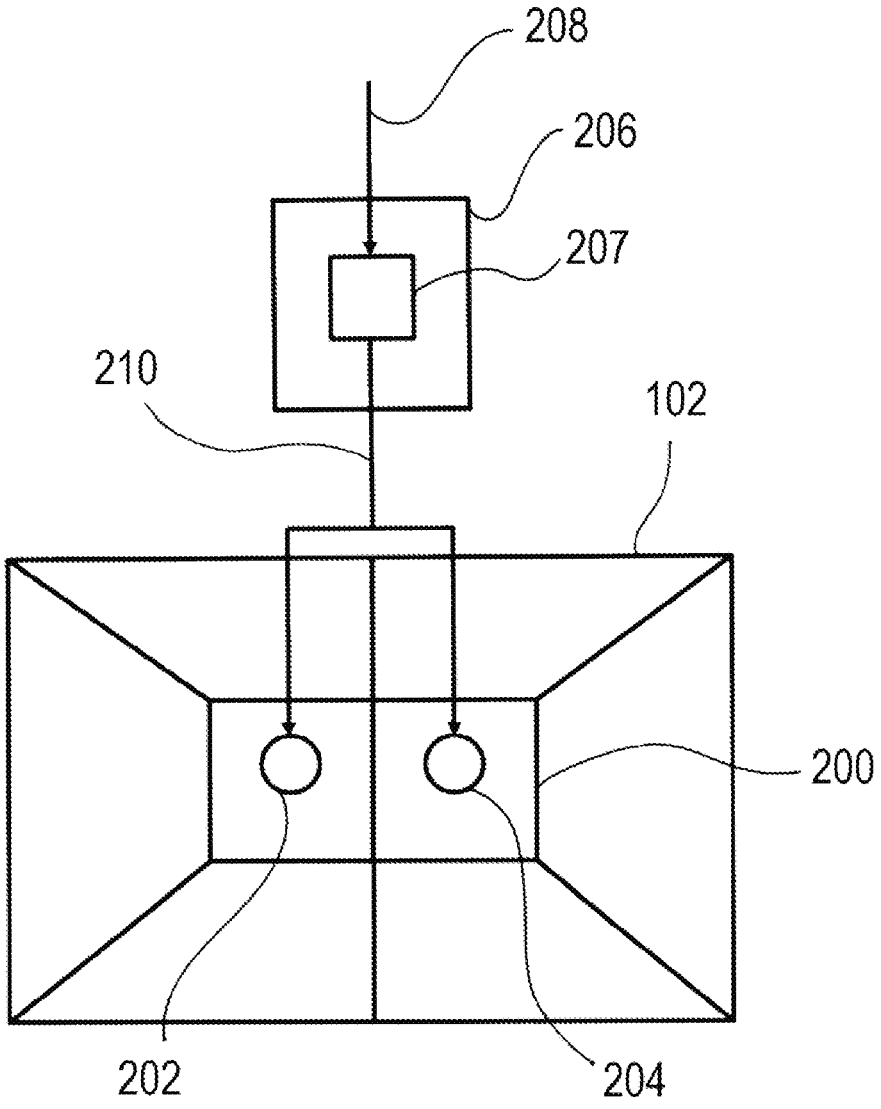
FIG. 2 shows a schematic illustration of a slide-in compartment of a washing machine from FIG. 1.

FIG. 2 shows a schematic illustration of a slide-in compartment 102 from FIG. 1. The slide-in compartment 102 is shown in the front view without the two detergent containers, such that a rear wall 200 of the slide-in compartment 102 is visible. According to this exemplary embodiment, a first light source 202 for backlighting the first detergent container and a second light source 204 for backlighting the second detergent container are arranged on the rear wall 200. According to an alternative exemplary embodiment, the slide-in compartment 102 has only one light source for backlighting both detergent containers or only one of the two detergent containers. The light sources 202, 204 are, for example, two light-emitting diodes which are directed onto the detergent containers—in this case, one onto each of the rear sides of the detergent containers—provided that these are pushed into the slide-in compartment 102. Alternatively, the light sources 202, 204 each have more than one light-emitting diode.

In contrast to the exemplary embodiment shown in FIG. 2, the first light source 202 or the second light source 204 may also be placed on another wall section of the slide-in compartment 102, for example on a side wall, a ceiling or a bottom of the slide-in compartment 102.

The two light sources 202, 204 are connected to a control device 206 of the washing machine. A control unit 207 of the control device 206 is configured to control the two light sources 202, 204 according to the fill levels of each of the detergent containers. For this purpose, the control device 206 is coupled, for example, to a suitable measuring device for measuring the respective fill level, from which the control unit 207 receives a measured value 208 representing the respective fill level. The control unit 207 evaluates the measured value 208 by comparing it with a lower or upper threshold value, the lower threshold value representing an empty detergent container and the upper threshold value representing a full detergent container. Depending on the result of the comparison, the control unit 207 generates a control signal 210 for switching the light sources 202, 204 on or off.

For example, the control unit 207 generates the control signal 210 to turn on the first light source 202 when the measurement value 208 reaches the lower threshold value. Conversely, the control unit 207 generates the control signal 210 in order to switch off the first light source 202 when the measured value 208 reaches the upper threshold value, which is the case, for example, after refilling or replacing the first detergent container. It makes a particularly strong effect if the first detergent container is made to blink by the first light source 202 alternately switching on and off by means of the control signal 210 when the empty state is detected.

The control of the second light source 204 by means of the control signal 210 may take place analogously to the control of the first light source 202 according to the fill level of the second detergent container.

Figure 3:
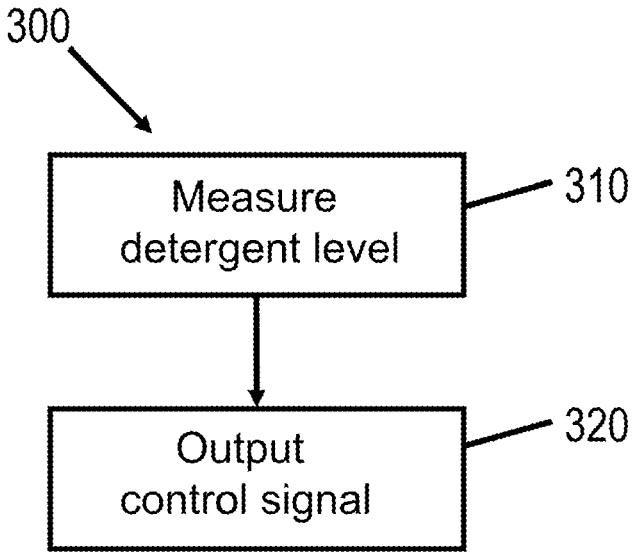
FIG. 3 shows a flowchart of a method according to an exemplary embodiment.

FIG. 3 shows a flowchart of a method 300 according to an exemplary embodiment. The method 300 for displaying a fill level of a detergent container in a washing machine may be carried out, for example, by the control device described above with reference to FIG. 2. In an optional step 310, the level of the detergent container is measured by a suitable measuring device of the washing machine, for example an optical measuring device, and the measured value representing the level is generated. In a further step 320, the control signal is output using the measured value in order to either switch the light source in the slide-in compartment on or off, or to alternately switch it on and off depending on the measured fill level.

The fill level display made by illuminating two detergent containers is made possible, for example, by affixing two light-emitting diodes opposite the rear side of the detergent containers in the slide-in compartment in a guide of the detergent containers.

Depending on the embodiment, different states of the detergent compartment are displayed as follows by appropriately controlling the light sources:

detergent compartment full: light off;

detergent compartment empty: blinking;

detergent compartment missing: light on.

According to a further exemplary embodiment, the light sources are controlled, by sensing the housing flap, such that the light sources are only switched on when the housing flap is opened.

The backlighting of the detergent compartment not only displays the empty state, but also the location of an empty detergent compartment. This results in better operator guidance.

While the above description constitutes the preferred embodiments of the present invention, the invention is susceptible to modification, variation and change without departing from the proper scope and fair meaning of the accompanying claims.

The invention claimed is:

1. A washing machine (100) comprising:

a slide-in compartment (102) for inserting at least one detergent container (104, 106) which is translucent at least in sections;

at least one light source (202, 204) arranged in the slide-in compartment (102) for illuminating the detergent container (104, 106); and a control device (206) configured to control the light source (202, 204) according to a fill level of the detergent container (104, 106).

2. The washing machine (100) according to claim 1, in which the light source (202, 204) is arranged on a rear wall (200) of the slide-in compartment (102).

3. The washing machine (100) according to claim 1, wherein the control device (206) is configured to switch on the light source (202, 204) when the fill level decreases to a lower threshold value, wherein the lower threshold value represents an empty detergent container (104, 106).

4. The washing machine (100) according to claim 3, wherein the control device (206) is configured to switch the light source (202, 204) alternately on and off when the fill level decreases to the lower threshold value.

5. The washing machine (100) according to claim 1, wherein the control device (206) is configured to switch off the light source (202, 204) when the fill level reaches an upper threshold value, wherein the upper threshold value represents a full detergent container (104, 106).

6. The washing machine (100) according to claim 1, wherein the control device (206) is configured to control the light source (202, 204) according to the presence of the detergent container (104, 106) in the slide-in compartment (102).

7. The washing machine (100) according to claim 1, further comprising a housing flap (108) for closing the slide-in compartment (102), wherein the control device (206) is configured to control the light source (202, 204) according to a position of the housing flap (108).

8. The washing machine (100) according to claim 1, wherein the light source (202, 204) is configured to emit light in a variable color spectrum, wherein the control device (206) is configured to vary the color spectrum depending on the fill level.

9. The washing machine (100) according to claim 1, further comprising the detergent container (104, 106) configured to be inserted into the slide-in compartment (102).

10. A method (300) for displaying a fill level of a detergent container (104, 106) in a washing machine (100) having a slide-in compartment (102) for inserting at least one detergent container (104, 106) which is translucent at least in sections; at least one light source (202, 204) arranged in the slide-in compartment (102) for illuminating the detergent container (104, 106); and a control device (206) configured to control the light source (202, 204) according to a fill level of the detergent container (104, 106), the method (300) comprising at least the following step:

outputting (320) a control signal (210) for controlling the light source (202, 204) using a measured value (208) representing a measured fill level of the detergent container (104, 106).

11. The washing machine according to claim 1, wherein the light source comprises at least one light-emitting diode.

* * * * *